US006267268B1

(12) United States Patent
Quartarone et al.

(10) Patent No.: US 6,267,268 B1
(45) **Date of Patent: *Jul. 31, 2001**

(54) MOUNTING BLOCK FOR SYRUP PUMP AND ACCESSORIES

(75) Inventors: Daniel S. Quartarone, Stone Mountain; Ehab Jaleel, Atlanta, both of GA (US); Steven T. Jersey, Laguan Niguel, CA (US); Brian Babson, Irvine, CA (US); Greg A. Petrie, San Dimas, CA (US); Douglas P. Goulet, Big Lake, MN (US)

(73) Assignee: The Coca-Cola Company, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/387,045

(22) Filed: Aug. 31, 1999

(51) Int. Cl.[7] ..... B67D 5/56

(52) U.S. Cl. ..... 222/129.1

(58) Field of Search ..... 222/129.1–129.4

(56) References Cited

U.S. PATENT DOCUMENTS

| | | | | |
|---|---|---|---|---|
| D. 410,470 | | 6/1999 | Filipek et al. | D15/7 |
| 3,902,636 | * | 9/1975 | Zilk | 222/129.1 |
| 4,247,133 | | 1/1981 | Möller | 285/4 |
| 5,152,429 | | 10/1992 | Billings | 222/129.2 |
| 5,492,455 | | 2/1996 | Durham et al. | 417/313 |
| 5,685,458 | * | 11/1997 | Durham et al. | 222/129.1 |

* cited by examiner

*Primary Examiner*—Philippe Derakshani
(74) *Attorney, Agent, or Firm*—Finnegan, Henderson, Farabow, Garrett & Dunner, L.L.P.

(57) ABSTRACT

A mounting block for use with a beverage dispenser system having a pump and a pump accessory. The mounting block includes a frame and a manifold. The manifold includes a number of ports and a line connecting the ports, such that the pump and the pump accessory can plug into the ports for fluid flow therebetween via the line.

27 Claims, 3 Drawing Sheets

MOUNTING BLOCK FOR SYRUP PUMP AND ACCESSORIES

RELATED APPLICATIONS

The following patent applications for related subject matter,

"Modular Beverage Dispenser Components" (Attorney Docket 03629-0420);

"Improved Cold Plate" (Attorney Docket 03628-0530); and

"Water Tank And Pump System" (Attorney Docket 03628-0540);

all of which are incorporated herein by reference, have been filed concurrently with the present application by the assignee of the present application.

TECHNICAL FIELD

The present invention relates generally to beverage dispenser systems and more particularly relates to a mounting block with a manifold for use with a syrup pump and a number of syrup pump accessories.

BACKGROUND OF THE INVENTION

Beverage dispensers, such as those used for carbonated soft drinks and the like, are well known in the art. A beverage dispenser generally includes a series of syrup circuits and water circuits. The syrup circuits generally include a syrup source, an incoming syrup line, a syrup pump, a means of cooling the syrup, and a dispensing valve. The source of the syrup may be a bag-in-box, a figal, a syrup tank, or any other type of conventional syrup source. The syrup pump pumps the syrup from the syrup source on to the cooling means and the dispensing nozzle. The cooling means may be a series of conventional syrup cooling coils located in an ice water bath or the cooling means may include a cold plate located under an ice chest. The syrup of the syrup circuits and the soda water from the water circuits are joined in the dispensing valve so as to produce the beverage. The beverage is then dispensed through a nozzle to the consumer.

The combination of these various beverage dispenser components, however, makes the construction or the repair of a beverage dispenser somewhat of a time consuming task. A typical beverage dispenser may have several of these syrup and water circuit components therein. The repair of a single component within the beverage dispenser generally requires the entire beverage dispenser to be taken out of service. Further, repair or replacement of any one of the components within a beverage dispenser may require the removal of several other components so as to gain access to the desired component.

For example, the removal of a single syrup pump from the beverage dispenser generally requires the entire beverage dispenser generally to be taken out of service. Replacement requires the removal of the various fittings connecting the pump to the syrup source and the cooling means and the removal of several screws, bolts, or other conventional types of fastening means. Removal of the syrup pump also inevitably leads to some spillage of the syrup within the pump or the lines. Further, each syrup pump generally has a number of accessories connected thereto. These accessories may include an air vent and an automatic selector valve. The air vent may be used to bleed the syrup line. The automatic selector valve is generally connected to two or more syrup sources. As one syrup source is extinguished, the automatic selector valve switches to the next source such that the syrup pump always has a continuous source of syrup. These accessories likewise must be removed whenever the syrup pump needs to be repaired or replaced.

What is needed, therefore, is a simplified means for the installation of and access to beverage dispenser components. These means should permit the quick installation and replacement of beverage dispenser components, such as a syrup pump or syrup pump accessories, without requiring the entire beverage dispenser to be shut down. Further, these goals must be accomplished in a cost efficient and safe manner.

SUMMARY OF THE INVENTION

The present invention thus provides a mounting block for use with a beverage dispenser system having a pump and a pump accessory. The mounting block includes a frame and a manifold. The manifold includes a number of ports and a line connecting the ports, such that the pump and the pump accessory can plug into the ports for fluid flow between that pump and the pump accessory via the line.

Specific embodiments of the present invention include the manifold having a number of lines, such that at least each pair of the ports is connected by one of the lines. The manifold may include a first pump accessory line and a second pump accessory line. The first pump accessory line includes a first pump accessory port and a first pump port. The pump accessory plugs into the first pump accessory port and the pump plugs into the first pump port. If the beverage dispenser system includes a second pump accessory, the second pump accessory line includes a second pump accessory port and a second pump port. The second pump accessory plugs into the second pump accessory port and the pump plugs into the second pump port. If the beverage dispenser system also includes one or more fluid lines, the manifold also may include an internal fluid line with a fluid line port and pump accessory port. The fluid line plugs into the fluid line port and the pump accessory plugs into the pump accessory port. The manifold also may include a gas line having a first gas port and a second gas port.

The manifold may be made out of thermoplastics, ceramics, or stainless steel. The ports may each include a cut-off valve positioned thereon. The frame may be a substantially rigid thermoplastic. The frame includes a number of recesses positioned therein. The recesses align with the ports of the manifold. The recesses also include a pump recess for mounting the pump therein. The frame may include a plurality of connection fittings such that a number of the mounting blocks may be interconnected.

A further embodiment of the present invention provides for a beverage dispenser system. The beverage dispenser system includes a mounting block, a pump mounted on the mounting block, and a pump accessory mounted on the mounting block. The mounting block includes a number of ports connected by connection lines. The pump and the pump accessory are in fluid communication with each other through the mounting block.

The pump accessory may be an automatic selection valve. The automatic selection valve may have a number of syrup source lines connected thereto. The syrup may flow through one of the syrup source lines, through the automatic selection valve, through the mounting block, and into the pump. The pump accessory also may be an air valve. The air valve may have a dispenser line, such that syrup flows from the pump, through the mounting block, through the air valve, and into the dispenser line. The beverage dispenser system also may have a number of pump accessories mounted on the mounting block such that the pump and the pump accessories are in fluid communication with each other through the mounting block.

The pump may be an air-driven pump. The pump may include an air fitting. The connection lines may include an air line such that the air line is in communication with the air fitting of the air-driven pump.

A further embodiment of the present invention provides for a mounting block for use with a beverage dispenser system. The beverage dispenser system includes a number of syrup sources, a number of syrup source lines, a number of pump accessories, a pump, and an outgoing line. The mounting block includes a frame and a manifold positioned within the frame. The manifold may have a number of passageways therein such that the syrup source lines, the pump accessories, the pump, and the outgoing line can plug into the passageways for fluid flow therethrough. Specifically, fluid may flow from the plurality of syrup sources, through the syrup source lines, through the pump accessories, through the pump, and through the outgoing line. The beverage dispenser system may further include a gas source, a gas source line, and a pump-gas line. The passageways may then include a gas passageway, such that the gas source line and the pump-gas line can plug into the gas passageway for gas flow from the gas source, through the gas source line, through the pump-gas line, and into the pump.

Other objects, features, and advantages of the present invention will become apparent upon review of the following detailed description of the preferred embodiments of the present invention, when taken in conjunction with the drawings and the appended claims.

DETAILED DESCRIPTION OF THE INVENTION

Figure 1:
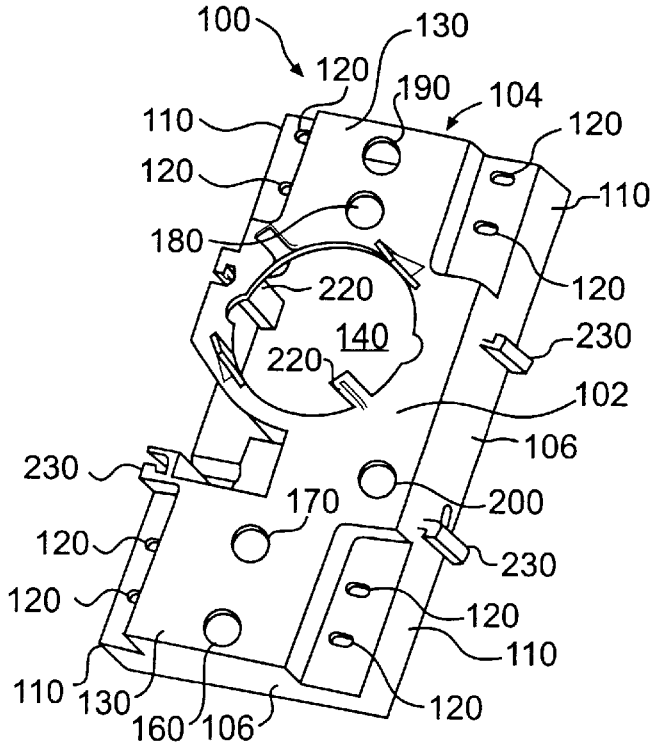
FIG. 1 is a perspective view of the frame of the mounting block of the present invention.
Figure 2:
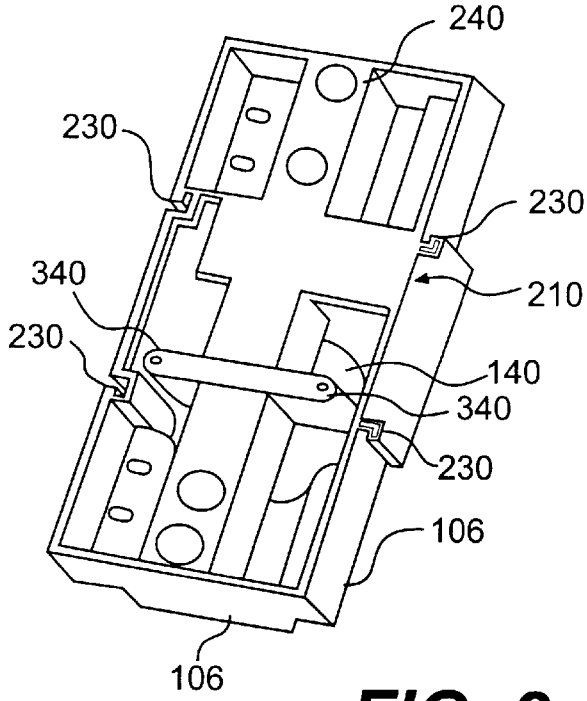
FIG. 2 is a perspective view of the manifold that fits within the frame of the present invention.

Referring now in more detail to the drawings, in which like numerals refer to like parts throughout the several views, FIGS. 1–5 show a modular mounting block 100 of the present invention. The mounting block 100 includes a frame 102 with a plurality of top surfaces 104 and a plurality of side surfaces 106. The frame 102 is preferably a unitary element. The frame 102 is preferably molded from a substantially rigid thermoplastic material such as Nylon, ABS (acrylonitrile-butadiene-styrene), acetal, or similar materials. The frame 102, however, can be made from any substantially rigid, noncorrosive material.

The frame 102 of the modular mounting block 100 itself may be essentially hollow in design. The top surfaces 104 of the frame 102 include a plurality of attachment surfaces 110. Each attachment surface 110 has one or more bolt holes 120 positioned therein. Specifically, the frame 102 has an attachment surface 110 positioned on each corner. Each attachment surface 110 preferably has two bolt holes 120. The mounting block 100 may be secured to a wall or other type of surface via bolts, screws, or other conventional types of fastening devices extending through the bolt holes 120 of the attachment surfaces 110.

The top surface 104 of the frame 102 of the modular mounting block 100 also has a mounting surface 130. The mounting surface 130 is raised above the attachment surfaces 110. The mounting surface 130 has a number of recesses positioned therein. Specifically, these recess include a pump recess 140 sized to accommodate a conventional syrup pump, a first syrup-in recess 160, a first syrup-out recess 170, a second syrup-in recess 180, and a second syrup-out recess 190. Further, the mounting surface 130 also has a carbon dioxide port 200 positioned therein. The frame 102 also has a side carbon dioxide port 210 positioned along one of its sides 106.

The frame 102 of the modular mounting block 100 also has a plurality of bosses 220 positioned on the mounting surface 130 so as to accommodate and support the various components, such as the syrup pump. Finally, the frame 102 has a number of connection fittings 230 positioned on each side such that a plurality of the modular mounting blocks 100 may be interconnected. Any number of the mounting blocks 100 may be used together.

Figure 3:
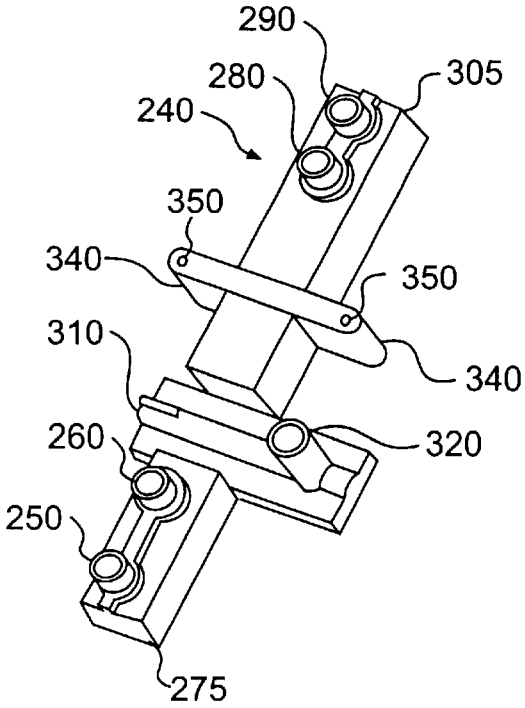
FIG. 3 is a rear perspective view of the frame and the manifold of the present invention.
Figure 4:
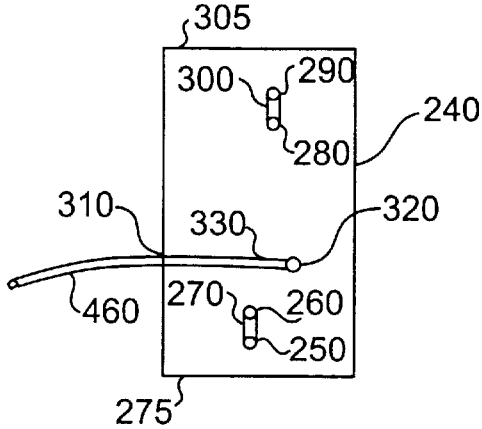
FIG. 4 is a front cross-sectional view of the frame and the manifold of the present invention.

FIGS. 3 and 4 show a manifold 240 of the present invention. The manifold 240 is positioned within the frame 102 of the modular mounting block 100. The manifold 240 has a first syrup-in port 250 and a first syrup-out port 260 connected by a first syrup line 270 on a first end 275 thereof and a second syrup-in port 280 and a second syrup-out port 290 connected by a second syrup line 300 on a second end 305 thereof. Positioned between the two syrup lines 270, 300 is a carbon dioxide-in port 310 and a carbon dioxide-out port 320 connected by a carbon dioxide line 330. The first syrup-in port 250 of the manifold 240 aligns with the first syrup-in recess 160 of the frame 102 while the first syrup-out port 260 of the manifold 240 aligns with the first syrup-out recess 170 of the frame 102. The second syrup in-port 280 of the manifold 240 aligns with the second syrup-in recess 180 of the frame 102 while the second syrup-out port 290 of the manifold 240 aligns with the second syrup-out recess 190 of the frame 102. The carbon dioxide-in port 310 aligns with the carbon dioxide side recess 210 while the carbon dioxide-out port 320 aligns with the carbon dioxide recess 200 of the frame 102. The manifold 240 also has a number of support arms 340. Each support arm 340 has a bolt hole 350 positioned therein such that the manifold 240 may be fixedly attached to the frame 102 by screws, bolts, or other conventional fastening means.

The manifold 240 may be a unitary structure. The manifold 240 may be formed by molding a substantially rigid thermoplastic. Alternatively, the syrup lines 270, 300 and the carbon dioxide line 330 may be made from a thermoplastic, as well as ceramics or stainless steel. In fact, ceramics or stainless steel may be preferred because certain types of soft drink syrup may penetrate into thermoplastic lines. This penetration may leave an odor or a taste remaining in the line such that the line can only be used with that particular type or flavor of syrup. Ceramic or stainless steel lines, however, can simply be flushed out and used with a different type of syrup. It is understood that although the frame 102 and the manifold 240 are described herein as being two distinct elements, the mounting block 100 may be an integral element.

Each of the manifold ports, the first syrup-in port 250, the first syrup-out port 260, the second syrup-in port 280, the second syrup-out port 290, the carbon dioxide-in port 310, and the carbon dioxide-out port 320, may have a valve 360 connected thereto. The valve 360 may open or shut the port 250, 260, 280, 290, 310, 320 as needed.

Figure 5:
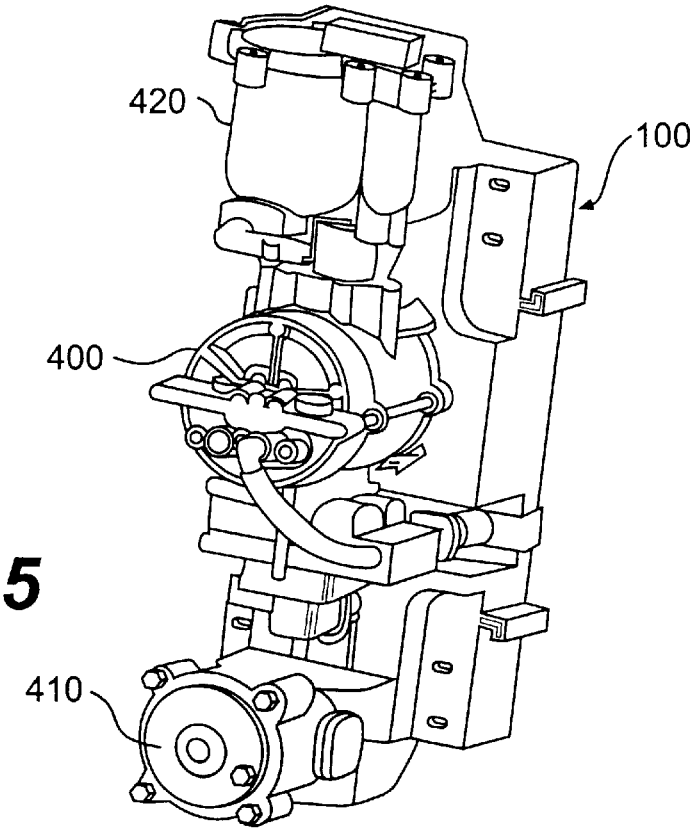
FIG. 5 is a perspective view of the mounting block of the present invention with a syrup pump, an automatic selector valve, and an air valve connected thereto.
Figure 6:
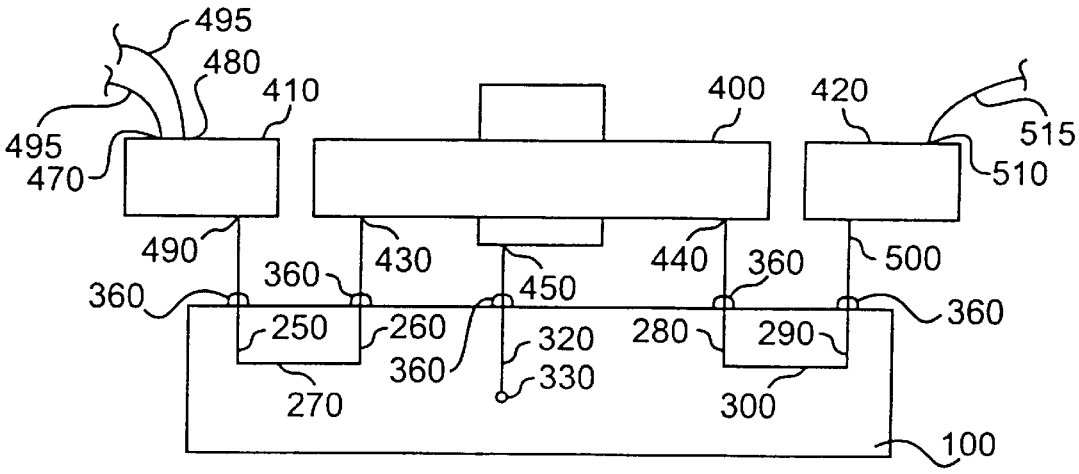
FIG. 6 is a schematic view of the mounting block of the present invention with the syrup pump, the automatic selector valve, and the air valve connected thereto.

FIGS. 5 and 6 show the modular mounting block 100 with a syrup pump 400, an automatic selector valve 410, and an air valve 420 connected thereto. The syrup pump 400 may be of conventional design. The pump 400 may be an air-driven pump. Specifically, the pump 400 may be driven by a source of carbon dioxide gas as is known to those skilled in the art. The syrup pump 400 has a syrup-in port 430, a syrup-out port 440, and a carbon dioxide-in port 450. The syrup pump 400 fits within the pump recess 140 of the modular mounting block 100 and is held in place by the bosses 220. The syrup pump 400 may be held within the pump recess 140 by a snap fit or by screws, bolts, or other conventional fastening means. The syrup-in port 430 of the syrup pump 400 is connected to the first syrup-out port 260 of the manifold 240. Likewise, the syrup out-port 440 of the syrup pump 400 is attached to the second syrup-in port 280 of the manifold 240. Finally, the carbon dioxide-in port 450 of the syrup pump 400 is connected to the carbon dioxide-out port 320 of the manifold 240 by a gas fitting 460.

The automatic selector valve 410 may be of conventional design. As described above, the automatic selector valve 410 switches the in-coming syrup source when the source in use is extinguished. The automatic selector valve 410 generally has a first syrup source-in port 470, a second syrup source-in port 480, and a syrup-out port 490. The syrup source-in ports 470, 480 are connected to the syrup sources via syrup source lines 495. The automatic selector valve 410 is attached to the modular mounting block 100 via the syrup-out port 490 mating with the first syrup-in port 250 of the manifold 240. Further, the automatic selector valve 410 also may be connected to the mounting block 100 by screws, bolts, or other conventional fastening means.

The air valve 420 also may be of conventional design. As described above, the air valve 420 allows the user to bleed air from the flow of syrup downstream of the pump 400 if needed. The air valve 420 generally has a syrup-in port 500 and a syrup-out port 510. The syrup-out port 510 is connected to the cooling means of the beverage dispenser via a dispenser line 515. The air valve 420 is attached to the modular mounting block 100 via the syrup-in port 500 mating with the second syrup-out port 290 of the manifold 240. Further, the air valve 420 also may be attached to the modular mounting block 100 by screws, bolts, or other conventional fastening means.

In use, the automatic selector valve 410 is connected to one or more syrup sources via the first syrup source-in port 470 and the second syrup source-in port 480. One of the syrup sources is used at a time by the automatic selector valve 410. The syrup travels through the automatic selector valve 410 and out through the syrup-out port 490. The syrup then travels through the first syrup line 270 of the manifold 240 via the first syrup-in port 250. The syrup then exits through the first syrup-out port 260 and into the syrup-in port 430 of the syrup pump 400. The syrup is then forced through the syrup pump 400 in a conventional manner with the help of the carbon dioxide gas flowing from a carbon dioxide source. The carbon dioxide gas flows through the manifold 240 from the carbon dioxide-in port 310, into the carbon dioxide line 330, and out via the carbon dioxide-out port 320. The carbon dioxide gas then flows into the carbon dioxide-in port 450 of the syrup pump 400 where it is used within the pump 400 in a conventional fashion. The syrup is then forced out of the syrup pump 400 via the syrup-out port 440 and back into the manifold 240 via the second syrup-in port 280. The syrup travels through the second syrup line 300 and exits via the second syrup-out port 290. The syrup then travels through the air valve 420 via the syrup-in port 500 and out towards the beverage dispenser components via the syrup-out port 510. The syrup then travels to the cooling means of the beverage dispenser as is known to those skilled in the art.

The valves 360 on the manifold ports (the first syrup-in port 250, the first syrup-out port 260, the second syrup-in port 280, the second syrup-out port 290, the carbon dioxide-in port 310, and the carbon dioxide-out port 320) may be opened or shut as the components (the pump 400, the automatic selector valve 410, and the air valve 420) are added and removed from the mounting block 100. The use of the valves 360 largely prevents the spillage of syrup and also allows for the components to be quickly replaced as needed.

Figure 7:
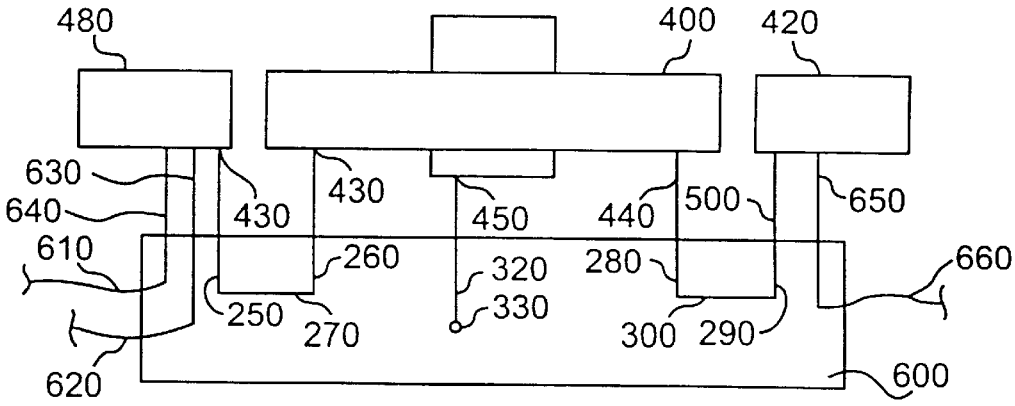
FIG. 7 is a schematic view of an alternative embodiment of the frame and the manifold of the present invention with the syrup pump, the automatic selector valve, and the air valve connected thereto.

FIG. 7 shows an alternative embodiment of the present invention. FIG. 7 shows a mounting block 600. The mounting block 600 is identical to the mounting block 100 with the exception that the syrup sources and the beverage dispenser cooling means are tied directly to the mounting block 100. Specifically, the mounting block 100 has two syrup source-in ports, a first syrup source-in port 610 and a second syrup source-in port 620. The mounting block 600 also has a first syrup source-out port 630 in communication with the first syrup source-in port 610 and a second syrup source-out port 640 in communication with the second syrup source-in port 620. Likewise, the mounting block 600 also has an air valve-in port 650 connected to the air valve 420 and a syrup-out port 660 connected between the mounting block 600 and the cooling means of the beverage dispenser.

In this embodiment, there is no need to connect the syrup source lines directly to the automatic selector valve 480 and no need to connect the air valve 420 directly to the cooling means lines. Rather, these lines are connected directly to the mounting block 600. This direct connection also reduces the time required to install or replace a component on the mounting block 100.

The modular mounting blocks 100, 600 of the present invention thus allow the user to install the syrup pump 400, the automatic selector valve 410, or the air valve 420 in a fast and efficient manner. Likewise, replacement of these components is also quick and easy to accomplish. Significantly, the user can replace one syrup pump 400 while the other syrup circuits of the beverage dispenser are still in operation. Thus, down time of the beverage dispenser as a whole is greatly reduced. Likewise, the time required to install or repair a beverage dispenser is also greatly reduced. Further, because the modular mounting block 100, 600 can be placed a distance away from the remaining beverage dispenser components, the components on the modular mounting block 100, 600 can be repaired or replaced without disrupting the user's operations.

It should be apparent that the foregoing description relates only to the preferred embodiments of the present invention and that numerous changes can be made herein without departing from the spirit and scope of the invention as defined by the following claims.

We claim:

1. A mounting block for use with a beverage dispenser system having a pump and a pump accessory, said mounting block comprising:

a frame; and a manifold positioned within said frame;

said manifold comprising a plurality of ports and a line connecting said plurality of ports, such that said pump and said pump accessory can plug into said plurality of ports for fluid flow between said pump and said pump accessory via said line.

2. The mounting block of claim 1, wherein said manifold further comprises a plurality of lines, such that at least each pair of said plurality of ports are connected by one of said plurality of lines.

3. The mounting block of claim 2, wherein said manifold comprises a first pump accessory line and a second pump accessory line.

4. The mounting block of claim 3, wherein said first pump accessory line comprises a first pump accessory port and a first pump port, such that said pump accessory plugs into said first pump accessory port and said pump plugs into said first pump port.

5. The mounting block of claim 3, wherein said beverage dispenser system further includes a second pump accessory, and wherein said second pump accessory line comprises a second pump accessory port and a second pump port, such that said second pump accessory plugs into said second pump accessory port and said pump plugs into said second pump port.

6. The mounting block of claim 2, wherein said plurality of lines comprises a gas line.

7. The mounting block of claim 6, wherein said gas line comprises a first gas port and a second gas port.

8. The mounting block of claim 1, wherein said manifold comprises a thermoplastic, a ceramic, or a stainless steel.

9. The mounting block of claim 1, wherein one or more of said plurality of ports comprise a valve positioned thereon.

10. The mounting block of claim 1, wherein said frame comprises a substantially rigid thermoplastic.

11. The mounting block of claim 1, wherein said frame comprises a plurality of recesses positioned therein.

12. The mounting block of claim 11, wherein said plurality of recesses aligns with said plurality of ports of said manifold.

13. The mounting block of claim 11, wherein said plurality of recesses comprises a pump recess for mounting said pump therein.

14. The mounting block of claim 1, wherein said frame comprises a plurality of connection fittings such that a plurality of said mounting blocks may be interconnected.

15. The mounting block of claim 1, wherein said beverage dispenser system further includes a fluid line and wherein said manifold comprises an internal fluid line.

16. The mounting block of claim 15, wherein said internal fluid line comprises a fluid line port and pump accessory port, such that said fluid line plugs into said fluid line port and said pump accessory plugs into said pump accessory port for fluid communication via said internal fluid line.

17. A beverage dispenser system, comprising:

a mounting block;

a pump mounted on said mounting block; and a pump accessory mounted on said mounting block;

said mounting block comprising a plurality of ports connected by a plurality of connection lines, such that said pump and said pump accessory are in fluid communication with each other through said mounting block.

18. The beverage dispenser system of claim 17, wherein said pump accessory comprises an automatic selection valve.

19. The beverage dispenser system of claim 18, wherein said automatic selection valve comprises a plurality of syrup source lines, such that syrup flows through one of said plurality of syrup source lines, through said automatic selection valve, through said mounting block, and into said pump.

20. The beverage dispenser system of claim 17, wherein said pump accessory comprises an air valve.

21. The beverage dispenser system of claim 20, wherein said air valve comprises a dispenser line, such that syrup flows from said pump, through said mounting block, through said air valve, and into said dispenser line.

22. The beverage dispenser system of claim 17, further comprising a plurality of pump accessories mounted on said mounting block such that said pump and said plurality of pump accessories are in fluid communication with each other through said mounting block.

23. The beverage dispenser system of claim 17, wherein said pump comprises an air-driven pump.

24. The beverage dispenser system of claim 23, wherein said wherein said air-driven pump comprises an air fitting.

25. The beverage dispenser of claim 24, wherein said plurality of connection lines comprises an air line and wherein said air line is in communication with said air fitting of said air-driven pump.

26. A mounting block for use with a beverage dispenser system having a plurality of syrup sources, a plurality of syrup source lines, a plurality of pump accessories, a pump, and an outgoing line, said mounting block comprising:

a frame; and a manifold positioned within said frame;

said manifold comprising a plurality of passageways such that said plurality of syrup source lines, said plurality of pump accessories, said pump, and said outgoing line can plug into said plurality of passageways for fluid flow from said plurality of syrup sources, through said plurality of syrup source lines, through said plurality of pump accessories, through said pump, and through said outgoing line.

27. The mounting block of claim 26, wherein said beverage dispenser system further comprises a gas source, a gas source line, and a pump-gas line, and wherein said plurality of passageways comprises a gas passageway, such that said gas source line and said pump-gas line can plug into said gas passageway for gas flow from said gas source, through said gas source line, through said pump-gas line, and into said pump.

* * * * *

UNITED STATES PATENT AND TRADEMARK OFFICE

CERTIFICATE OF CORRECTION

PATENT NO. : 6,267,268 B1
DATED : July 31, 2001
INVENTOR(S) : Quartarone et al.

It is certified that error appears in the above-identified patent and that said Letters Patent is hereby corrected as shown below:

Column 8, claim 24,
Line 33, before "air-driven pump" delete "wherein said."

Signed and Sealed this

Twenty-sixth Day of March, 2002

*Attest:*

*Attesting Officer*

JAMES E. ROGAN
*Director of the United States Patent and Trademark Office*